United States Patent [19]

Mizuo

[11] Patent Number: 4,514,971

[45] Date of Patent: May 7, 1985

[54] APPARATUS FOR MANUFACTURING SCREENED CABLE

[76] Inventor: Yasuhiko Mizuo, 29-7, Honta 5-chome, Kokubunji-shi, Tokyo, Japan, 185

[21] Appl. No.: 483,844

[22] Filed: Apr. 8, 1983

[30] Foreign Application Priority Data

May 10, 1982 [JP] Japan ..... 57-77887

[51] Int. Cl.[3] ..... B21D 13/00; H01B 13/22; H01B 7/20

[52] U.S. Cl. ..... 57/9; 57/6; 57/311; 174/102 D

[58] Field of Search ..... 57/3, 6, 7, 9, 138, 57/219, 311; 174/102 D

[56] References Cited

U.S. PATENT DOCUMENTS

| | | | |
|---|---|---|---|
| 3,137,120 | 6/1964 | Budenbender | 57/7 X |
| 3,602,633 | 8/1971 | Miller | 174/102 D X |
| 3,651,244 | 3/1972 | Silver et al. | 174/102 D X |
| 3,681,904 | 8/1972 | Stieg | 57/3 |
| 4,151,365 | 4/1979 | Hacker | 174/102 D X |
| 4,216,645 | 8/1980 | Andersen | 174/102 D X |
| 4,225,749 | 9/1980 | Pierre et al. | 174/102 D X |
| 4,360,395 | 11/1982 | Suzuki | 174/102 D X |

FOREIGN PATENT DOCUMENTS

| | | |
|---|---|---|
| 401082 | 11/1933 | United Kingdom . |
| 736018 | 8/1955 | United Kingdom . |
| 1168478 | 10/1969 | United Kingdom . |

*Primary Examiner*—Donald Watkins

*Attorney, Agent, or Firm*—Wenderoth, Lind & Ponack

[57] ABSTRACT

The deformation of corrugations in a corrugated conductive tape, utilized as a screened layer for screened cables or as an outer conductor for coaxial cables, due to pulling tension of the screened cable is prevented by an apparatus for manufacturing screened cables such that the corrugated conductive tape is transferred at the same rate as a cable core which is covered by the corrugated conductive tape by a forming device.

3 Claims, 9 Drawing Figures

19
18a2
1
3
12
18a1
19

19
18b2
3
12
1
18b1

19a
19
19b
18c2
12
1
19
18c1
3

19
18d2
12
1
3
18d1
19

APPARATUS FOR MANUFACTURING SCREENED CABLE

BACKGROUND OF THE INVENTION

1. Field of the Invention

This invention relates to an apparatus for manufacturing screened cables, and particularly to an apparatus for manufacturing screened or shielded cables wherein even if a thin conductive tape having a wavy pattern (including corrugation, embossment, and any other suitable wavy pattern, but hereinafter referred to simply as "corrugated tape") is utilized for a layer as screening or shielding the cable or as an outer conductor for a coaxial cable, a cable core provided with an insulating layer can be longitidinally covered with such corrugated thin tape without deforming the corrugation thereof.

2. Description of the Prior Art

There has been proposed such screened cable, for example as shown in FIG. 1, wherein the circumference of a paper tape 2 wound around a cable core 1 is covered longitudinally with a corrugated aluminum tape 3, and then the resulting member has applied thereover a sheath 4.

In this type of screened cable, a corrugated aluminum tape 3 having a thickness of, for instance, 0.2 mm or more is used to withstand the pulling tension (e.g., the cable core 1 has a 15 mm outer diameter, and the aluminum tape 3 has a 1 mm wave crest and a 2.5 mm pitch) in order to avoid deformation of the member 3, even though the pulling tension of the cable is increased at the time of manufacturing the same.

FIG. 2 is an explanatory view showing an apparatus for manufacturing the above screened cable which comprises a delivery drum 5 around which the cable core 1 is wound, a taping machine 6 for winding the paper tape 2 around the cable core 1, a drum 7 for winding the corrugated aluminum tape 3 utilized for longitudinally covering the cable core 1 around which the paper tape 2 is wound, a forming die 8 for covering the cable core 1 provided with the paper tape 2 with the corrugated aluminum tape 3, a sheath extruder 9 for providing the sheath 4 around the outside of the longitudinally covered cable core, a cooler 10 for cooling the extruded sheath 4, and a wind-up drum 11 for pulling the resulting screened cable which has been cooled by means of the cooler 10 (a pulling capstan and like are omitted).

In the above apparatus, the paper tape 2 is wound around the cable core 1, transferred in the pulling direction thereof, by means of the taping machine 6. Then the resulting cable core is longitudinally covered with the corrugated aluminum tape 3, which has previously been wound around the aluminum tape drum 7, by means of the forming die 8 (for instance, the aluminum tape 3 has an overlapped dimension of 5 mm). Furthermore, the sheath 4 is provided around the longitudinally covered cable core to cover the same by means of the sheath extruder 9, and thereafter the resulting screened cable is cooled by the cooler 10. The screened cable thus manufactured is finally wound up by means of the wind-up drum 11.

However, in such conventional apparatus for manufacturing screened cables as mentioned above pulling tension applied to the corrugated aluminum tape 3 can not be relieved at the time of manufacturing the screened cables. Accordingly, there is such disadvantage that the corrugated aluminum tape 3 is deformed, thereby destroying the corrugation, if the pulling tension increases in response to speeding up of the manufacturing rate.

Particularly, since such a thin corrugated aluminum tape having a thickness of less than 0.2 mm is used in a small diameter screened cable, there is such disadvantage that it is difficult to manufacture such small diameter screened cables while maintaining a prescribed productivity.

SUMMARY OF THE INVENTION

Accordingly, an object of the present invention is to provide an apparatus for manufacturing screened cables whereby a corrugated conductive tape is applied longitudinally to cover the circumference of an insulating layer over a cable core, and is not deformed, even if pulling tension is applied to the cable core.

It is another object of the present invention to provide an apparatus for manufacturing screened cables by which such screened cables can be manufactured with a high productivity, even if the pulling speed of the cables is increased.

It is still another object of the present invention to provide an apparatus for manufacturing screened cables by which a high-quality screened cable with excellent electrical characteristics can be manufactured.

In order to attain the above stated objects, an apparatus for manufacturing screened cables according to the present invention includes means for disposing longitudinally a corrugated conductive tape around the circumference of an insulating layer of the cable, as a screened layer for shielding the cable or as an outer conductor for a coaxial cable, means for reducing pulling tension applied to the aforesaid corrugated conductive tape by making the corrugated tape advance at a rate in response to the pulling speed of the cable, and means for forming the corrugated conductive tape, the pulling tension of which has been reduced, around the insulating layer of the cable.

DESCRIPTION OF THE PREFERRED EMBODIMENTS

Figure 1:
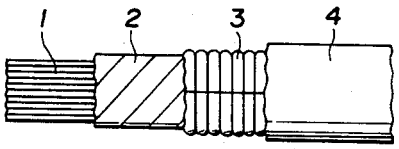
FIG. 1 is a cutaway view showing an example of a conventional screened cable.
Figure 3:
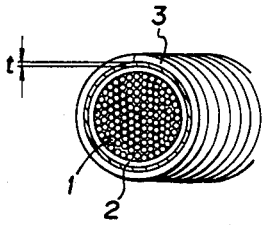
FIG. 3 is a perspective view showing a construction of an embodiment of the cable manufactured by the apparatus for manufacturing screened cables according to the present invention.

FIG. 3 shows an example of a screened cable manufactured in accordance with the present invention and including a cable core 1 having wound therearound a paper tape 2, and the circumference of which is longitudinally covered with, for example, a corrugated aluminum tape 3 having a thickness t of less than 0.2 mm (a sheath is omitted from FIG. 3 for simplicity of illustration.

Figure 2:
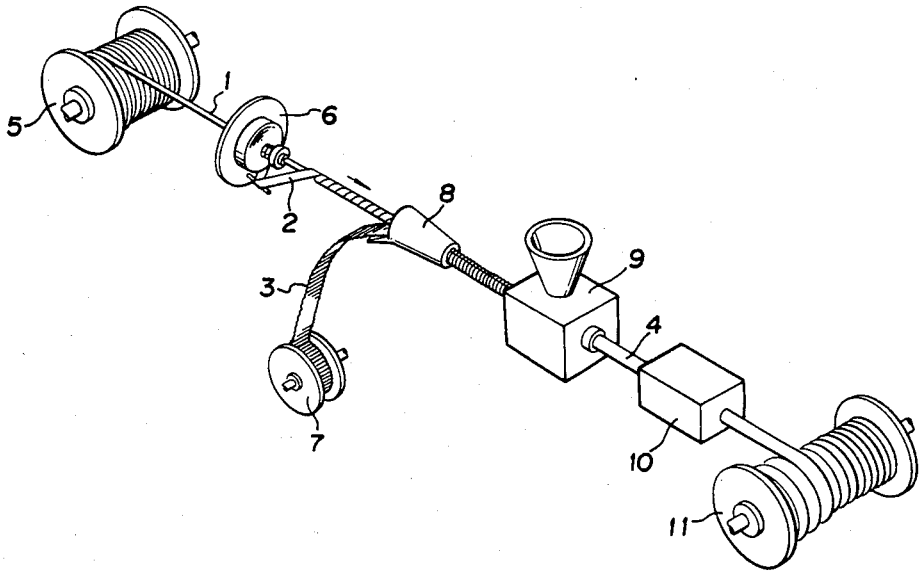
FIG. 2 is a perspective view showing a conventional apparatus for manufacturing screened cables.
Figure 4:
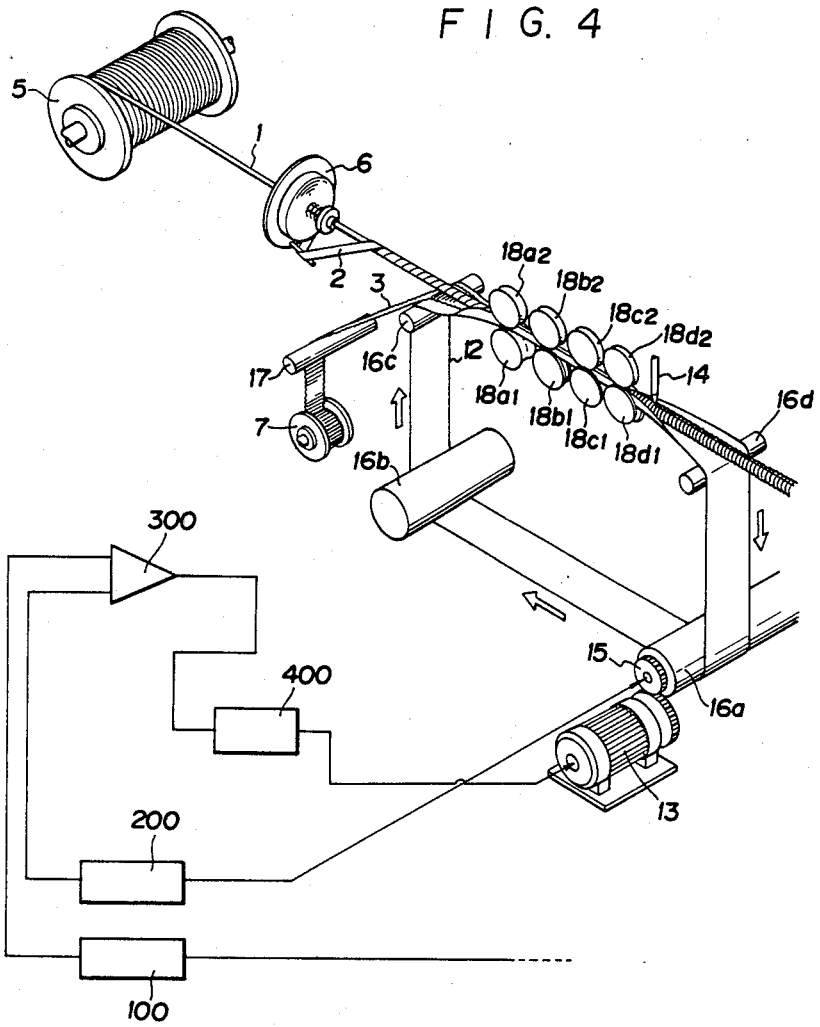
FIG. 4 is a perspective view showing an embodiment of the apparatus for manufacturing screened cables according to the present invention.

FIG. 4 shows one embodiment of the apparatus according to the present invention wherein the same parts as those of FIG. 2 are designated by the same reference numerals as in FIG. 2, so that repeated explanations will be unnecessary. The apparatus comprises a supporting and advancing member 12, e.g. an endless web or belt, for transferring the corrugated aluminum tape 3 in the pulling direction of the screened cable, a motor 13 for moving the advancing member 12 in the direction indicated by arrows and at the same rate as the cable core 1, plural pairs of forming rolls 18*a*1, 18*a*2; 18*b*1, 18*b*2; 18*c*1, 18*c*2; 18*d*1, 18*d*2; . . . for forming the corrugated aluminum tape 3, a nozzle 14 for bonding overlapped portions at both sides of the corrugated aluminum tape 3 to each other (which may be omitted), a driving wheel 16*a* provided with a gear 15 which is driven by the motor 13, idle wheels 16*b*, 16*c* and 16*d* for stretching and carrying the advancing member 12, and a guide roll 17 for guiding the corrugated aluminum tape 3. Each of the aforesaid plural pairs of forming rolls 18*a*1, 18*a*2; 18*b*1, 18*b*2; 18*c*1, 18*c*2; 18*d*1, 18*d*2; . . . consists of a pair of upper and lower rolls disposed in such a manner that the cable core 1 is passed between concave surfaces of the upper and lower rolls, respectively. At least a part of the traveling plane of the advancing die 12 stretched between opposite wheels 16*a* and 16*b* and that between the opposite wheels 16*c* and 16*d* are constructed respectively to travel parallel to the under side of the cable core 1 and to travel together with the cable core 1 and the corrugated aluminum tape 3 between the respective pairs of the upper and lower rolls of the forming rolls 18*a*1, 18*a*2; 18*b*1, 18*b*2; 18*c*1, 18*c*2; 18*d*1, 18*d*2; . . . .

. Furthermore, a squeezing die (designated by reference numeral 8 in FIG. 2) may be provided between the final pair of forming rolls (18*d*1, 18*d*2 in the embodiment of FIG. 4) and the nozzle 14.

Figures 5A, 5B, 5C, 5D:
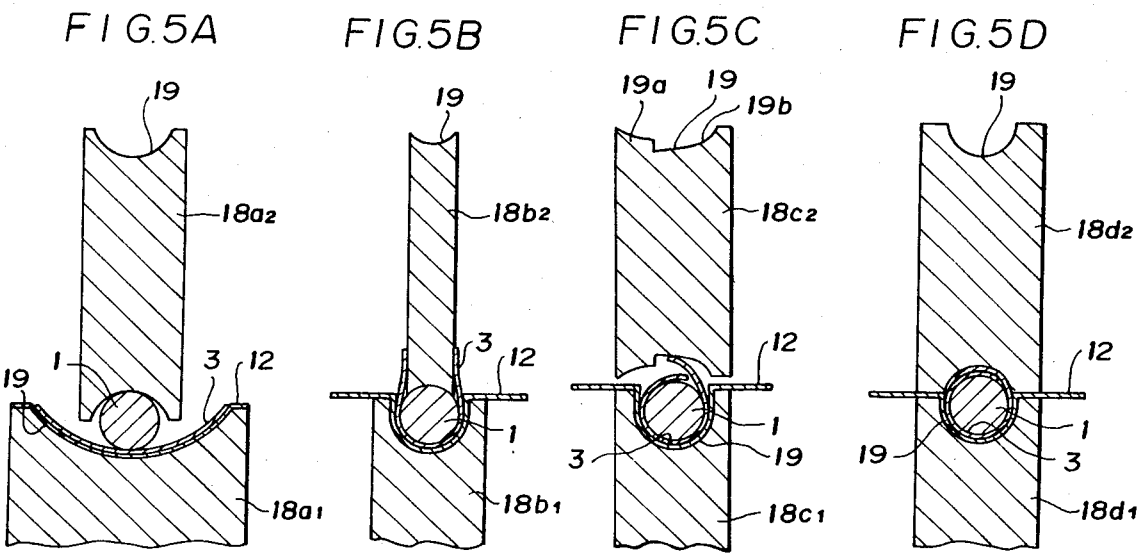
FIGS. 5(A), (B), (C) and (D) are sectional views illustrating the procedure of forming a screened cable by means of forming rolls in the apparatus of FIG. 4.

In the above apparatus, the cable core 1 is delivered from a delivery drum 5 to a taping machine 6. The advancing member 12 is advanced by means of the driving wheel 16*a* driven by the motor 13 at the same rate as the cable core 1 in the directions indicated by the arrows. The corrugated aluminum tape 3 is drawn into a gap between the advancing member 12 and the cable core 1 at the position of the roll 16*c*, and then the tape is transferred on the advancing member 12 at the same rate as the cable core 1, thereby to smoothly pass through a gap between the forming rolls 18*a*1 and 18*a*2. As a result, the pulling tension of the cable core 1 applied to the aluminum tape 3 is relieved so that deformation thereof can be avoided. Concave surfaces are defined in the forming rolls, the profiles of which change gradually with progress of the operation as shown in FIGS. 5(A)–5(D), and a screened cable is formed by pressing the cable core 1 and the aluminum tape 3 together with the advancing member 12 between the respective concave surfaces 19 defined by the respective pairs of upper and lower forming rolls. The forming procedure will be described in more detail hereinbelow. Namely, FIGS. 5(A), 5(B) and 5(C) illustrate preliminary forming steps wherein the aluminum tape 3 is first pressed together with the advancing die member in between the rolls 18*a*1 and 18*a*2 as shown in FIG. 5(A). Then the aluminum tape 3 is pressed in a gap between the rolls 18*b*1 and 18*b*2, whereby both ends of the aluminum tape 3 rise upwardly as shown in FIG. 5(B). The two ends of the aluminum tape 3 thus raised are moved by means of the upper roll 18*c*2 to overlap with each other as shown in FIG. 5(C). The aforesaid upper roll 18*c*2 is defined to have a step like configuration in the concave surface 19, and one edge of the aluminum tape 3 is first shaped on the inner side with respect to the other edge of the aluminum tape by means of a projection 19*a* in the aforesaid configuration, while the latter edge of the aluminum tape 3 is formed to overlap the former edge of the aluminum tape by means of a recess 19*b* in the configuration. Then, the aluminum tape 3 is pressed between the rolls 18*d*1 and 18*d*2 to complete the forming thereof as shown in FIG. 5(D). It is to be noted that the rolls 18*c*1 and 18*c*2 may be omitted in the case where the edges of the aluminum tape 3 are shaped so as not to overlap each other, but to butt each other.

The overlapped portion (or the butted portion) of the aluminum tape 3 thus longitudinally formed is soldered by means of the nozzle 14, and then a sheath is applied thereon.

Speed control of the advancing member 12 is effected in such a manner that a sensor signal derived from a first sensor 100 outputting a signal in response to the speed of a pulling capstan (not shown) is compared with that of a second sensor 200 outputting signal in response to the speed of the advancing member 12 by means of a differential amplifier 300, whereby the speed of the motor 13 is controlled by a control circuit 400 in such a member that the difference between the signals compared becomes zero. Instead of such a control circuit as described above, an advancing die driving part may be connected with the pulling capstan through gears.

Figure 6:
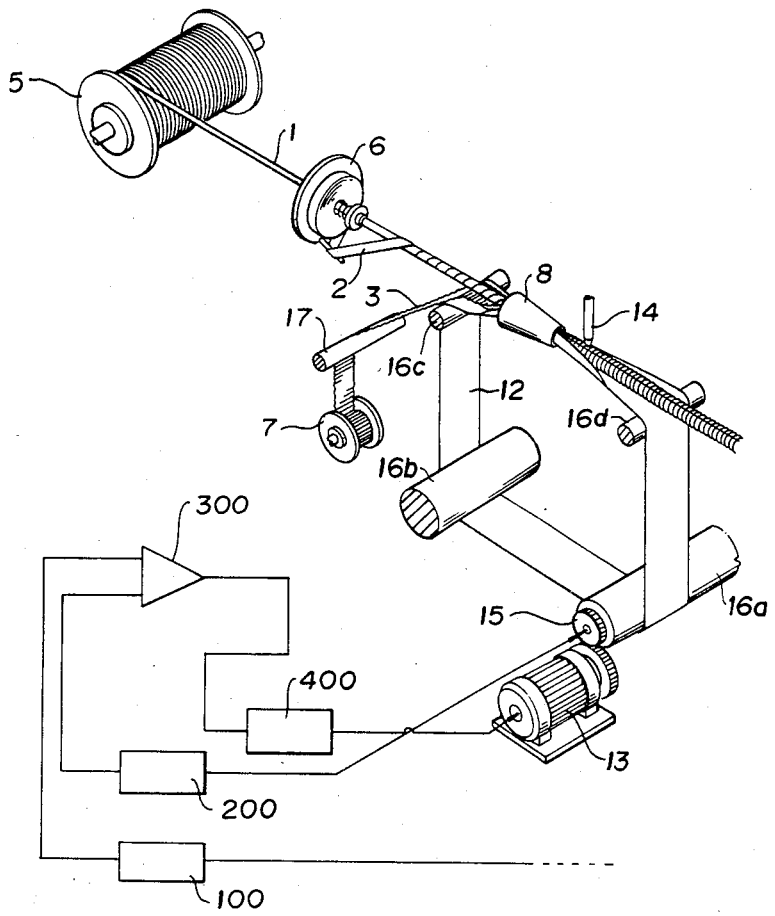
FIG. 6 is a perspective view showing another embodiment of the apparatus for manufacturing screened cables according to the present invention.

FIG. 6 illustrates another embodiment of the apparatus for manufacturing screened cables according to the present invention. In this embodiment the same parts as those of the embodiment of FIG. 4 are designated by the same reference numerals. Accordingly, the description relating to the overlapped constructions and operations of these embodiments will be omitted in the following explanation, but it is to be noted that the embodiment of FIG. 6 differs from that of FIG. 4 in that a forming die 8 is employed as the forming mechanism. The forming die 8 is constructed such that a cable core is covered with a corrugated aluminum tape introduced from the inlet side of the forming die while allowing the cable core to pass together with the tape through an inner bore surface of the forming die 8, the inner diameter of which decreases gradually, and the screened cable is produced when it is dicharged from the outlet side of die.

Furthermore, although the above embodiments have been described in connection with screened cables, it should be noted that the apparatus according to the present invention may also be applicable to the manufacture of coaxial cables in a manner similar to manufacture of the screened cables.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In an apparatus for manufacturing a screened cable and of the type wherein a wavily patterned conductive tape is supplied from a supply to a core also supplied from a supply, and including means for longitudinally forming said tape around said core, thereby forming a screened cable, and means for pulling the thus formed cable through the apparatus, thereby imparting tension to said cable, the improvement wherein said forming means comprises at least two pairs of rolls, each said pair of rolls comprising a first roll having a concave peripheral surface shaped for pressing said tape against said core, and a second roll having a concave peripheral surface shaped for deforming opposite edges of said tape over said core, and of means for relieving said tension on said tape during said forming thereof around said core, said tension relieving means comprising:

means for supporting and advancing said tape between said rolls of said forming means during the period of forming thereby of said tape around said core; and means separate from said pulling means, for moving said supporting and advancing means, and thereby said tape, in the same direction and at the same speed as said cable is moved by said pulling means;

whereby said rolls of said forming means longitudinally form said tape around the circumference of said core in an untensioned state of said tape.

2. The improvement claimed in claim 1, wherein said supporting and advancing means comprises an endless belt passing with said tape through said roll of said forming means.

3. The improvement claimed in claim 2, wherein said moving means comprises a motor for driving said endless belt.

* * * * *